United States Patent [19]

Joshi

[11] Patent Number: 4,879,016

[45] **Date of Patent: * Nov. 7, 1989**

[54] ELECTROLYTE ASSEMBLY FOR OXYGEN GENERATING DEVICE AND ELECTRODES THEREFOR

[75] Inventor: Ashok V. Joshi, Salt Lake City, Utah

[73] Assignee: Ceramatec, Inc., Salt Lake City, Utah

[ * ] Notice: The portion of the term of this patent subsequent to Feb. 16, 2005 has been disclaimed.

[21] Appl. No.: 156,549

[22] Filed: Feb. 16, 1988

Related U.S. Application Data

[63] Continuation-in-part of Ser. No. 889,214, Jul. 25, 1986, Pat. No. 4,725,346.

[51] Int. Cl.[4] ..... C25B 1/02; C25B 9/00

[52] U.S. Cl. ..... 204/242; 204/129; 204/130; 204/421; 204/424; 204/427; 429/30

[58] Field of Search ..... 204/15, 130, 242, 129, 204/421–429; 429/30–33, 104

[56] References Cited

U.S. PATENT DOCUMENTS

| | | | |
|---|---|---|---|
| 3,989,614 | 11/1976 | Tien | 204/426 |
| 4,040,929 | 8/1977 | Bauer et al. | 204/426 |
| 4,257,863 | 3/1981 | Hoffman | 204/427 |
| 4,359,374 | 11/1982 | Sano et al. | 204/429 |
| 4,412,904 | 11/1983 | Rohr et al. | 204/424 |
| 4,720,335 | 1/1988 | Fukushima et al. | 204/424 |
| 4,725,346 | 2/1988 | Joshi | 204/427 |

*Primary Examiner*—T. Tung

*Attorney, Agent, or Firm*—Trask, Britt & Rossa

[57] ABSTRACT

An electrochemical oxygen generating device employing oxygen-conducting metal oxide electrolyte, a nonporous silver or silver alloy containing electrode and an electrode undercoat comprising a ceramic oxide electronic conductor is disclosed.

8 Claims, 2 Drawing Sheets

ELECTROLYTE ASSEMBLY FOR OXYGEN GENERATING DEVICE AND ELECTRODES THEREFOR

RELATED APPLICATION

This application is a continuation in part of U.S. Application Ser. No. 889,214, filed July 25, 2986, now U.S. Pat. No. 4,725,346.

BACKGROUND OF THE INVENTION

1. Field:

This invention generally relates to oxygen generating devices and particularly to electrochemical oxygen generating devices using a solid oxygen ion conducting electrolyte composed of a metal oxide ceramic material.

2. Prior Art:

Electrochemical devices which employ oxygen ion conducting electrolytes are well known. Such devices are used as sensors whereby the oxygen partial pressure difference existing between opposite sides of said electrolyte create a voltage potential which may be determined to indicate a level of oxygen concentration on one side or the other, especially when the oxygen concentration on one side of the sensor is known. Such sensors are used in automobile engines, furnaces and other devices wherein it is desired to operate at stoichiometric ratios between the fuel and the air or oxygen necessary for combustion of fuel.

Also, such electrochemical devices, when operated in a current mode with an applied voltage may be utilized to generate pure oxygen. Devices of this type are discussed in certain patents to Ruka.

Certain difficulties have generally been encountered with such oxygen sensors and oxygen generating devices. In electrochemical sensors it is common practice to utilize platinum as an electrode or to utilize various electrode layers, for example, a platinum electrode adjacent to the electrolyte with an overcoating of a protective porous film. Platinum has been generally employed because of its catalytic activity and because of its relatively high melting point among conductive metals. It has been found, however, in oxygen generating electrochemical cells that platinum, which is relatively conductive, has an apparent resistance which is much higher than what would normally be expected. Thus, oxygen generating electrochemical cells utilizing platinum electrodes have been electrically inefficient. Furthermore, platinum electrodes must be porous in order to permit oxygen molecules to pass physically through the electrode layer, to reach the surface of the electrolyte (cathode), and, upon recombination at the anode surface, to depart from the electrolyte surface and physically pass through the anode layer. While such pores are necessary for oxygen flow, the effective electrode-electrolyte interface at the electrode-electrolyte surface for electrical purposes is consequently reduced. Also, the existence of pores in an electrode increases substantially the sheet resistance of such an electrode.

SUMMARY OF THE INVENTION

The instant invention relates to electrolyte assemblies for electrochemical oxygen generating devices and particularly to an assembly which utilizes silver or silver alloy electrodes and especially to improved electrodes containing metal or metal oxide additives and to improved electrodes having undercoats of a metal oxide material. The electrolyte in such devices is typically zirconia, hafnia, ceria or bismuth oxide.

DESCRIPTION OF INVENTION

An electrically efficient oxygen generating device has been invented. The invention particularly relates to an electrolyte cell assembly for such an oxygen generating device and particularly to the electrodes used in such a cell assembly.

An efficient electrochemical oxygen generating device, as described herein, employs an electrolyte cell assembly comprising a zirconia, hafnia, ceria or bismuth oxide electrolyte which is substantially impervious to gas molecules, said electrolyte having a pair of surfaces which are substantially parallel, said surfaces either being cylindrical, planar or other convenient shape, in which the electrolyte surfaces have a coating of a substantially non-porous electrode material of silver or silver alloy containing substantial quantities of silver. The silver or silver containing electrodes may be substantially non-porous inasmuch as silver is pervious to oxygen molecules.

Further description of the invention may be facilitated by reference to the attached drawings.

Figure 1:
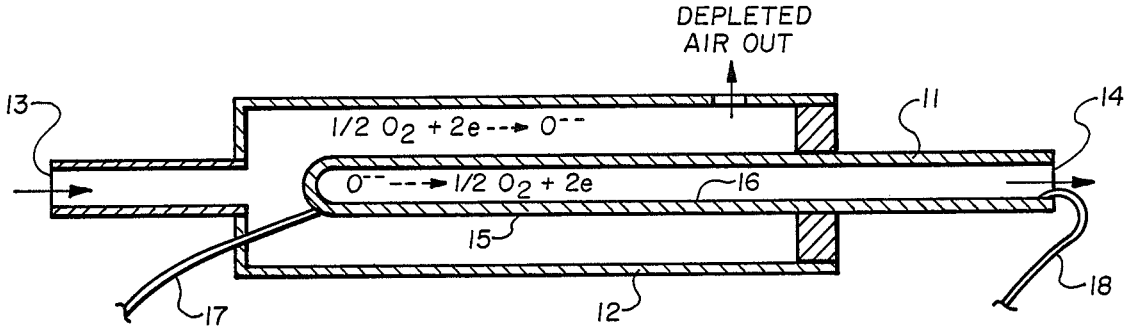
FIG. 1 is a schematic view of an electrochemical oxygen generating device.

FIG. 1 illustrates a portion of an electrochemical oxygen generating device which has a tubular electrolyte 11 residing within a sealed enclosure 12 having an air inlet 13 and a oxygen outlet 14. Substantial portions of the electrolyte tube 11 contained within the sealed enclosure 12 is coated on its external surface with an electrode 15 and on its internal surface with another electrode 16. Current is introduced to the external electrode 15 by conductor lead 17 and to the interior electrode by conductor lead 18. Thus, by applying a voltage across the conductor leads a current may be caused to pass through the wall of the electrolyte 11. The current carrying means through the electrolyte wall are oxygen ions. The reaction of the oxygen is illustrated in FIG. 1.

At the interface between external electrode 15 (cathode) and the electrolyte, oxygen dissociates by the addition of electrons into ions of oxygen. At the internal interface of the electrolyte and internal electrode (anode) the oxygen ions recombine to produce a molecule of oxygen which then diffuses through the silver containing anode to be discharged from the tube at outlet 14.

A characteristic of the electrolytes identified herein is that they are substantially impervious to nitrogen and oxygen molecules. Thus, the electrolyte is a solid, substantially non-porous, impervious material, which under the influence of electrical voltage causes current to pass through the electrolyte wall via oxygen ions which migrate from one electrolyte surface to the other.

The conductors, i.e., electrodes, utilized in the instant invention are silver, alloys of silver and composites of silver and oxide ion conductive materials. Preferably such alloys and composites contain a very high portion of silver in addition to such other conductive materials combined with the silver. Other metals which may be alloyed with silver to create useful electrodes for purposes of the instant invention are palladium, platinum, gold and copper. Also, certain conductive ceramic oxides may be alloyed with the silver, an example of such a ceramic material being lanthanum strontium manganate and other metal oxides more fully disclosed hereinafter.

Silver and alloys of silver containing substantial proportions of silver are particularly effective electrodes for oxygen generating devices. To generate oxygen efficiently and abundantly per unit area of electrolyte surface it is desired that the maximum number of oxygen molecules be present at the cathode-electrolyte interface. Also, from an electrical standpoint, it is desired that each unit area of electrolyte surface be in intimate electrical contact with an equivalent unit area of electrode to maximize the number of ions available per unit area. Silver and silver alloy electrodes, especially at the temperatures utilized in oxygen generating devices, for example, about 500° C. up to about 800° C., have a high diffusivity coefficient for oxygen molecules. Thus, the electrical electrode-electrolyte contact area need not be reduced by the presence of a large percentage of pores, as is necessary for platinum and other conductive metals having a low oxygen diffusivity, in order to maximize the presence of oxygen molecules at the electrolyte-electrode interfaces.

Figure 2:
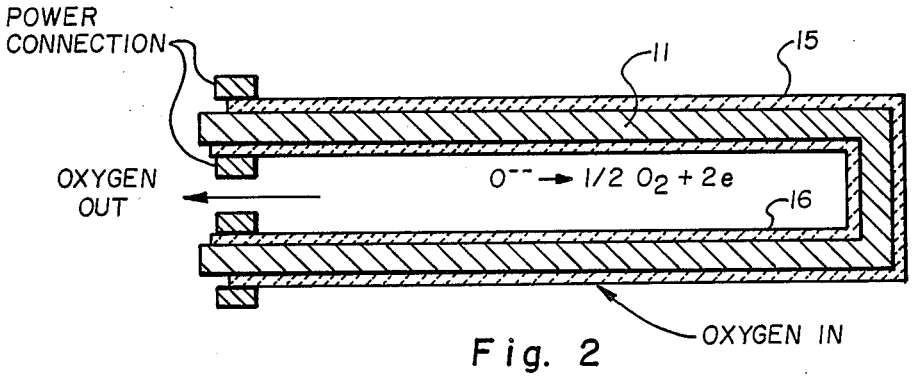
FIG. 2 is a schematic view of an electrolyte cell assembly of electrochemical generating device.

In FIG. 2 an electrolyte cell assembly is illustrated in which an electrolyte 11 is coated with an outer electrode 15 and an inner electrode 16. These electrodes may be of the same or slightly different compositions. For example, the external electrode may be of pure silver while the internal electrode may be of an alloy or such compositions may be reversed. These electrodes are usually applied in thicknesses of about 1 micron to about 20 microns or more and preferably from about 6 microns to 12 microns. Also, it is generally desired to have the electrodes substantially coextensive with one another; that is, the area of the external electrode coating is substantially the same as is the internal electrode. Also, since silver and silver alloys are pervious (permeable) to gaseous oxygen, the electrodes are preferably substantially continuous, substantially non-porous and substantially uniform in thickness.

It may be desirable in certain instances to provide a protective outer coating for the electrodes. Such coatings may be ceramic or oxide semiconductive materials such as lanthanum strontium manganate (LSM) and other similar corrosion resistant materials. Such protective coating materials are generally porous to permit gaseous oxygen to pass therethrough. Certain materials such as LSM, as more fully disclosed hereinafter, may be very effectively used as an undercoat material, either in a porous or non-porous state.

Figure 3:
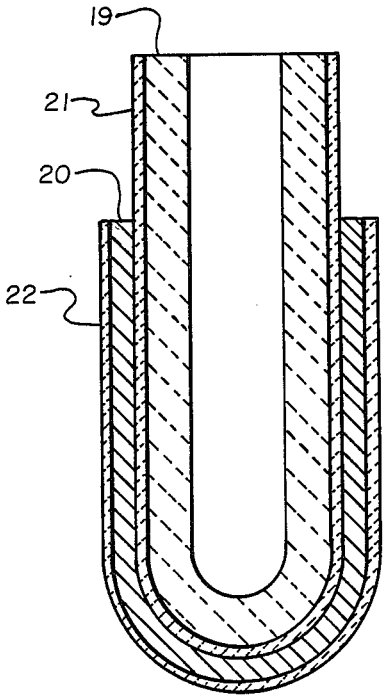
FIG. 3 is a schematic of an electrolyte cell assembly utilizing a very thin walled, electrolyte cell assembly.

Another cell assembly is illustrated in FIG. 3. A porous ceramic substrate 19 is a primary structural member of this particular cell inasmuch as the electrolyte 20 is a very thin material which would be non-self supporting or, if self supporting, very fragile if it were not for the main structural porous ceramic substrate 19. Electrodes 21 and 22 are positioned on either side of the thin film solid electrolyte to provide effective electrical contact between the electrolyte and the electrodes.

The cell illustrated in FIG. 3 may be made by coating a porous alumina ceramic tube, for example, with a silver electrode by painting the electrode onto the alumina and sintering it at a temperature of about 800° to form the finished electrode substrate combination. The electrode coated porous alumina tube may then be dipped in an appropriate slip, that is, a water slurry of a particulate oxide material such as one containing very minute particles of bismuth oxide to form a thin continuous film on the electrode coated substrate in a typical slip casting technique. After collecting a significantly thick coating of wet electrolyte ceramic oxide on the silver electrode substrate article, the complete article is fired to form a solid, substantially non-porous, continuous thin film of sintered electrolyte onto the continuous silver electrode/porous ceramic substrate combination. A second electrode is then placed onto the exterior of the sintered electrolyte, which is then fired to form a completed article of the type illustrated in FIG. 3.

The advantage of the article illustrated in FIG. 3 is that the electrolyte is very thin so that a minimal distance exists between electrodes so that an oxygen ion migrating from one electrode to another has a very short distance to go. From an overall electrical circuit standpoint, a thin electrolyte creates less electrical resistance than a thicker electrolyte. Thin electrolytes are electrically efficient as well as being thermally efficient. Electrolytes such as zirconia, hafnia, ceria and bismuth oxide are more ion conductive, i.e., transport oxygen ions as a faster rate per unit area at elevated temperatures than they do at lower temperatures. For example, it is generally desired to operate a zirconia electrolyte based oxygen generating system at a temperature of at least about 500° degrees celsius and preferably above about 700° to 800° C. to achieve efficient operation. Bismuth oxide electrolytes operate efficiently at lower temperatures than zirconia, for example, oxygen ion transport rate for bismuth oxide at about 500° C. is equivalent to that of zirconia at about 800° C. for the same area and wall thickness of the electrolytes. Thin-walled electrolytes do provide signi- ficant advantages to solid state electrochemical oxygen delivery systems of the type described herein.

The thickness of the electrolyte wall for a cell such as that illustrated in FIG. 3 may be from about 20 microns to about 100 microns. In comparison, an electrolyte thickness of a cell of the types illustrated in FIG. 1 & 2 wherein the electrolyte is made by pressing of a dry material and then subsequently firing it to a self-supporting structural shape is generally in the order of about 0.5 millimeters to about 2.0 millimeters.

In a device such as that illustrated in FIG. 3 the ceramic substrate must have a significant porosity and preferably be as thin as possible so that air or oxygen migrates readily through the porous ceramic substrate inasmuch as the porous ceramic substrate is either adjacent the cathode or the anode. Thus, the interior of the ceramic substrate tube may be a chamber from which oxygen is evacuated, i.e. discharged, or into which air is introduced.

A thin electrolyte may be formed also by plasma or flame spraying of very small particles of zirconia, hafnia, ceria or bismuth oxide onto an appropriate substrate of an electrode coated porous ceramic substrate. Although the particles achieve a very high temperature and very high velocities, the gross energy content of the particles is relatively low because of the small size of the particles. Thus, very hot particles may be sprayed upon a silver electrode which has a melting point of about 900° C. without causing substantial melting of the electrode.

A very thin, substantially continuous substantially non-porous electrolyte may be formed by plasma and flame spraying techniques. The zirconia, hafnia, ceria and bismuth oxide particles may be very pure or may contain dopants such as yttria, ytterbia, calcia and the like to improve strength, toughness or electrical properties. Such dopants usually are present in minor quantities, e.g., less than about 10% by weight. Other materials, such as alumina, mullite and the like, may be incorporated in the electrolytes to act as fluxes to lower the sintering temperature of the material or to affect other processing characteristics of the material.

In making electrolyte assemblies to be utilized in oxygen generating devices for medical applications it is generally not necessary that 100% pure oxygen be obtained. Thus, the electrolyte and electrodes need not be prepared with such care that no pores exist in the electrolyte assembly. If some air leakage occurs in a medical oxygen generating device, the device is still very useful. In medical devices, if the oxygen content of air can be increased from about 21% to 50% and especially to about 80% then further oxygen enhancement is generally not required. In fact, pure 100% oxygen is generally diluted with some air when oxygen therapy is provided to a patient.

From the standpoint of electrical efficiency, it is generally desired that the porosity of the electrodes and electrolytes be maintained fairly low. Pores in electrodes cause the sheet resistance to increase inasmuch as electron flow must take circuitous paths. Also, pores in the electrode, or electrolyte, diminish the effective electrode-electrolyte interface area, further decreasing electrical efficiency. If, however, the electrolyte wall thickness may be made very thin, less than about 10 microns, then the effects of some porosity of the electrolyte will be offset by the very short path of travel for oxygen ions migrating from one electrolyte surface to the other.

Thin continuous substantially non-porous electrodes of substantially uniform thickness are preferred. Electrodes of silver and silver alloys may be applied as conventional liquid formulations to electrolytes, or in the case of devices of the type illustrated in FIG. 3 to a substrate support surface such as a porous ceramic or metal. These liquid formulations are then dried and sintered according to conventional techniques. Such coating methods are effective, however, the electrode coatings are relatively thick, i.e. from about eight microns to about 50 microns and relatively non-uniform in thickness.

Very thin silver and silver alloy electrodes which are substantially uniform in thickness and substantially non-porous may be obtained by sputtering or vapor deposition techniques. Electrode coatings of a thickness of about four microns to 30 microns which are substantially continuous and non-porous are readily achieved by sputtering or vapor deposition.

A device of the type illustrated in FIG. 1 employing a pressed and sintered zirconia electrolyte tube with one closed end having a wall thickness of about 1.0 millimeter was coated on each surface with a silver electrode by painting and firing of a liquid silver coating formulation. The electrodes were continuous, substantially non-porous and with a thickness of about 8 microns.

This device was operated in a furnace such that the temperature of the device was about 800° C. A voltage of about 1.0 volts at current of about 5 amps produced essentially pure oxygen at a rate of about one liter per hour.

In contrast a similar device with a similarly sized zirconia tube and with porous platinum electrodes of about the same area and thickness when operated at approximately the same temperature, voltage etc. produced oxygen at a rate of about 200 cubic centimeters per hour.

Composite Electrodes

Improved electrodes comprising silver or silver alloys, especially silver alloyed with other noble metals, may be further enhanced by addition of certain electronically conductive metal or metal oxide additives. The addition of copper, copper oxide, nickel or nickel oxide to a silver electrode significantly lowers the resistance of the electrode. When such an electrode is applied to an oxygen ion transporting solid electrolyte, enhanced oxygen transport occurs.

Figure 4:
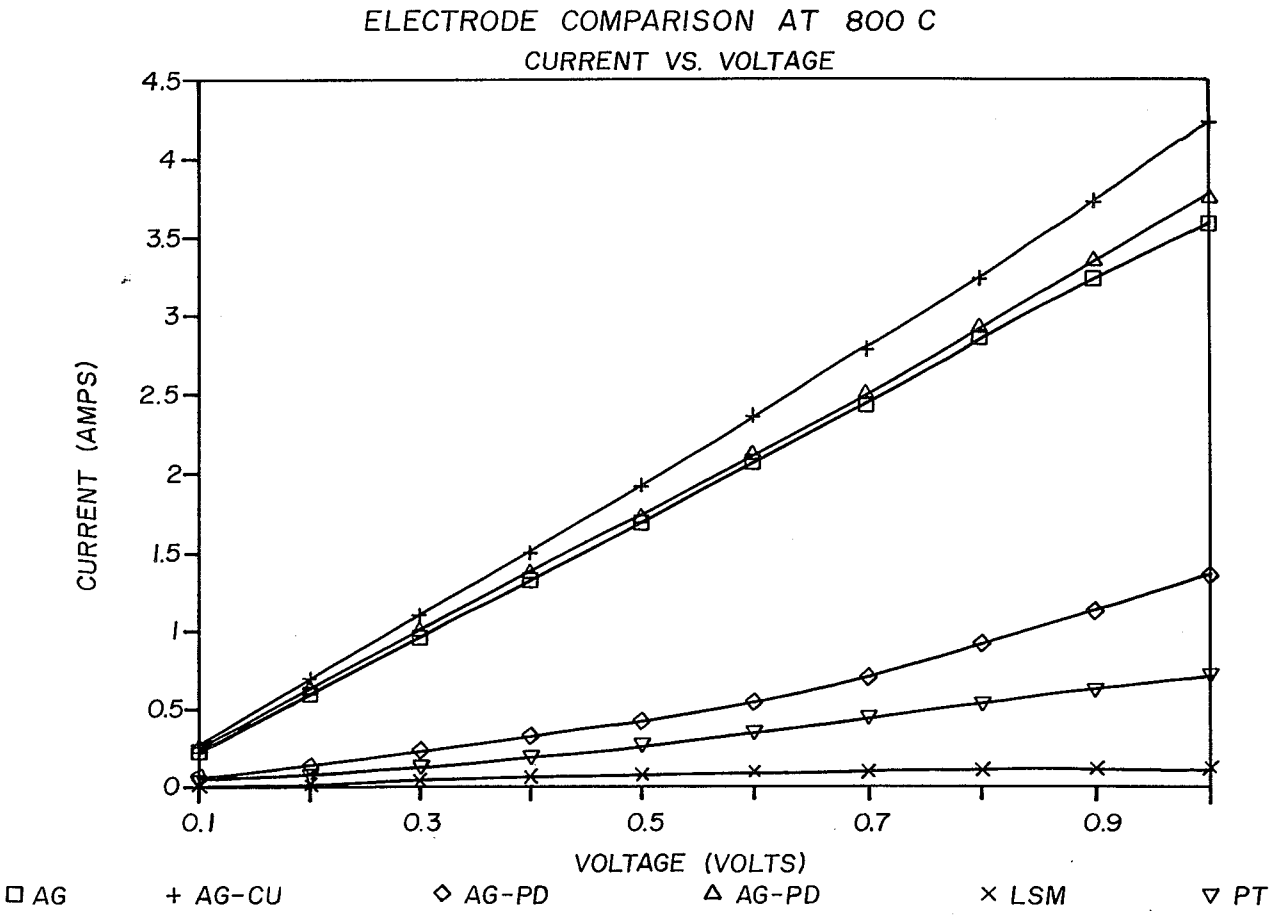
FIG. 4 is a graph comparing current vs. voltage for several different electrode compositions.

The effectiveness of a copper or nickel additive is illustrated in FIG. 4, which plots current vs. voltage at 800° C. for three electrodes, namely, a pure silver electrode, a silver copper electrode (Cu present as 1–10% by weight), and a silver-nickel electrode (Ni present as 0–20% by weight) and silver manganese (0–35% manganese by weight). At the elevated operating temperatures of an oxygen generating device, the copper and nickel will oxidize, especially in the presence of high oxygen concentrations, to $Cu_2O$ and $Ni_2O$.

The presence of even minor quantities of copper, nickel, copper oxide or nickel oxide in a silver electrode enhances the performance of the electrode. Minor quantities of such additives, especially since an oxide is formed, improves adherence of the electrode to the ceramic metal oxide electrolyte. The presence of such additives in amounts up to 35% by weight of the electrode may be utilized while a preferred upper limit is about 5–15% by weight of additive depending on additive itself.

Other additives such as LSM, $LaCrO_3$ and like ceramic metal oxides may be used in minor quantities in the silver and silver alloy electrodes of the instant invention in minor quantities to improve adhesion, wetting and similar characteristics of the electrode/electrolyte interface. The ceramic metal oxides, although electronically conductive, tend to diminish the electroconductivity of the silver or silver alloy electrodes. However, improvements in adhesion, wetting and the like may facilitate longer life for the electrodes.

Electrode Undercoats

An undercoat layer of an electronically conductive metal oxide between the electrode and electrolyte may enhance electrode wetting and adhesion of the electrode to the electrolyte. Also, because of the migratory nature of silver at the operating temperatures of an oxygen delivering device, such metal oxide undercoats may effectively seal minute fissures in the electrolyte, thus preventing silver from migrating from one electrode to the other to cause a dead short. Thus, a very thin undercoat may enable electrolytes containing minute fissures to be successfully used. Also, because the oxygen delivery system may be exposed to thermal cycling which may cause thermal shock-induced fissures, a thin undercoat coextensive with at least one of the electrodes may be very useful.

The undercoats useful in the invention generally are continuous film or coatings having a substantially uniform thickness of about 8 to about 800 microns, although preferably less than about 20 microns. Preferably, the undercoating is continuous, although discontinuous film may be utilized for adhesion-improving purposes.

The undercoats, generally because of their oxide condition, need not have artificially induced porosity although porous undercoats may be effectively utilized. Thin oxide layers tend to be diffuse oxygen at the operating temperatures involved in an oxygen delivery system employing ceramic oxide electrolytes. Also, such undercoats, when fired, achieve a density of approximately 60 to 80% of theoretical density. Densification to higher densities is very difficult to achieve for any ceramic material. Also, long sintering schedules at elevated temperatures are required to achieve higher densities, thus being uneconomical and creating greater likelihood of thermal shock since there will seldom be an exact match between the coefficient of thermal expansion of the ceramic electrolyte to that of the metal oxide undercoat. Thus, some very minimal natural porosity may exist in the undercoat which, because of its very thin nature, may permit enhanced oxygen diffusion. (Even zirconia electrolytes are sintered only to about 95% of theoretical density, however, the thickness of the electrolyte essentially precludes any migration of gas molecules through the electrolyte.)

What is claimed is:

1. In a ceramic electrolyte having oxygen transport characteristics suitably sized to provide useful oxygen quantities and a substantially non-porous silver electrode for conducting electrons and oxygen molecules and/or ions to said electrolyte surface or surfaces, the improvement comprising:

an electrode undercoat comprising a ceramic oxide electronic conductor adherent to said electrolyte surface.

2. The improvement of claim 1 wherein said undercoat is lanthanum strontium manganate.

3. The improvement of claim 1 wherein said undercoat is a thin, substantially continuous film substantially coextensive with said electrode.

4. The improvement of claim 1 wherein said undercoat has a density of at least about 50% as a percent of theoretical density.

5. The improvement of claim 1 wherein said undercoat in an unfired state contains substantially no porosity-inducing additives.

6. The improvement of claim 1 wherein said undercoat is a substantially non-continuous thin film.

7. The improvement of claim 1 wherein said undercoat is substantially porous.

8. The improvement of claim 1 wherein said undercoat is substantially non-porous.

* * * * *

UNITED STATES PATENT OFFICE

CERTIFICATE OF CORRECTION

Patent No. 4,879,016 Dated NOV. 7, 1989

Inventor(s) Ashok V. Joshi

It is certified that error appears in the above-identified patent and that said Letters Patent is hereby corrected as shown below:

In column 8, line 16, change "50%" to --60%--

Signed and Sealed this

Nineteenth Day of October, 1993

Bruce Lehman

*Attest:*

BRUCE LEHMAN

*Attesting Officer*

*Commissioner of Patents and Trademarks*